US010703102B2

(12) United States Patent
Giusti et al.

(10) Patent No.: US 10,703,102 B2
(45) Date of Patent: Jul. 7, 2020

(54) MICROFLUIDIC MEMS DEVICE WITH PIEZOELECTRIC ACTUATION AND MANUFACTURING PROCESS THEREOF

(71) Applicant: STMICROELECTRONICS S.R.L., Agrate Brianza (IT)

(72) Inventors: Domenico Giusti, Monza (IT); Mauro Cattaneo, Milan (IT); Carlo Luigi Prelini, Seveso (IT)

(73) Assignee: STMICROELECTRONICS S.R.L., Agrate Brianza (IT)

( * ) Notice: Subject to any disclaimer, the term of this patent is extended or adjusted under 35 U.S.C. 154(b) by 0 days.

(21) Appl. No.: 16/030,630

(22) Filed: Jul. 9, 2018

(65) Prior Publication Data

US 2019/0023014 A1 Jan. 24, 2019

(30) Foreign Application Priority Data

Jul. 20, 2017 (IT) ..... 102017000082961

(51) Int. Cl.
*B41J 2/14* (2006.01)
*B41J 2/16* (2006.01)

(52) U.S. Cl.
CPC ..... *B41J 2/14233* (2013.01); *B41J 2/161* (2013.01); *B41J 2/1623* (2013.01); *B41J 2/1626* (2013.01);
(Continued)

(58) Field of Classification Search
None
See application file for complete search history.

(56) References Cited

U.S. PATENT DOCUMENTS 6,547,376 B1 4/2003 Watanabe et al.
9,174,445 B1 11/2015 Prati et al.
(Continued)

FOREIGN PATENT DOCUMENTS

EP 1506864 A1 2/2005
JP 11309867 A 11/1999
JP 200259555 A 2/2002

OTHER PUBLICATIONS

Young et al., *Roark's Formulas for Stress and Strain*, 7th ed., McGraw-Hill, New York, New York, USA, 2002, p. 504. (3 pages).
(Continued)

*Primary Examiner* — Erica S Lin
(74) *Attorney, Agent, or Firm* — Seed Intellectual Property Law Group LLP

(57) ABSTRACT

The microfluidic device has a plurality of ejector elements. Each ejector element includes a first region, accommodating a first fluid flow channel and an actuator chamber; a second region, accommodating a fluid containment chamber; and a third region, accommodating a second fluid flow channel. The fluid containment chamber is fluidically coupled to the first and to the second fluid flow channels. The second region is formed from a membrane layer, from a membrane definition layer, mechanically coupled to the membrane layer and having a membrane definition opening, and a fluid chamber defining body, mechanically coupled to the membrane definition layer and having a chamber defining opening, with a width greater than the width of the membrane definition opening. The width of the membrane is thus defined by the width of the chamber defining opening.

19 Claims, 9 Drawing Sheets

(52) U.S. Cl.
CPC ..... *B41J 2/1628* (2013.01); *B41J 2/1631* (2013.01); *B41J 2/1632* (2013.01); *B41J 2/1642* (2013.01); *B41J 2002/1437* (2013.01)

(56) References Cited

U.S. PATENT DOCUMENTS

| | | | | |
|---|---|---|---|---|
| 2005/0036011 | A1 | 2/2005 | Watanabe | |
| 2007/0279456 | A1 | 12/2007 | Shimada | |
| 2012/0268526 | A1 | 10/2012 | Huffman et al. | |
| 2014/0313264 | A1* | 10/2014 | Cattaneo | B41J 2/14233 347/68 |
| 2017/0182778 | A1 | 6/2017 | Cattaneo et al. | |
| 2018/0065371 | A1 | 3/2018 | Cattaneo et al. | |

OTHER PUBLICATIONS

Takahashi, "Adaptability of Piezoelectric Inkjet Head," *NIP17: International Conference on Digital Printing Technologies*, Sep. 30-Oct. 5, 2001, pp. 323-327.

* cited by examiner

MICROFLUIDIC MEMS DEVICE WITH PIEZOELECTRIC ACTUATION AND MANUFACTURING PROCESS THEREOF

BACKGROUND

Technical Field

The present disclosure relates to a microfluidic MEMS ("Micro Electro-Mechanical System") device and to the related manufacturing process.

Description of the Related Art

As is known, for the spraying of inks and/or scents, for example perfumes, the use of microfluidic devices with small dimensions, which may be fabricated using microelectronics fabrication techniques, has been proposed.

For example, U.S. Pat. No. 9,174,445 describes a microfluidic device designed for the thermal spraying of ink onto paper.

Another type of microfluidic device designed for the spraying of fluids is based on the piezoelectric principle. In particular, devices with piezoelectric actuation may be classified on the basis of the mode of oscillation—longitudinal or transverse. In the following, reference will be made to devices operating in transverse mode, without the disclosure being limited to this category of devices.

One exemplary embodiment of a microfluidic device with piezoelectric actuation of the transverse type is described for example in U.S. Pat. Pub. No. 2014/0313264 and is shown in FIG. 1, referring to a single ejector element, indicated with 1 and integrated into a semiconductor substrate.

The ejector element 1 in FIG. 1 comprises a lower portion, an intermediate portion and an upper portion, mutually superposed and bonded.

The lower portion is composed of a first region 2, made of semiconductor material, having an inlet channel 10.

The intermediate portion is formed from a second region 3, of semiconductor material, which laterally bounds a fluid containment chamber 12. The fluid containment chamber 12 is furthermore bounded at the bottom by the first region 2 and at the top by a membrane layer 4, for example of silicon oxide. The area of the membrane layer 4 on top of the fluid containment chamber 12 forms a membrane 7. The membrane layer 4 is formed with a thickness so as to be able to deflect, which is for example around 2.5 μm.

The upper portion is formed from a third region 5, of semiconductor material, which bounds an actuator chamber 6, superposed onto the fluid containment chamber 12 and onto the membrane 7. The third region 5 has a through-channel 13, in communication with the fluid containment chamber 12 through a corresponding opening 14 in the membrane layer 4.

A piezoelectric actuator 8 is disposed on top of the membrane 7, in the actuator chamber 6. The piezoelectric actuator 8 is composed of a pair of mutually superposed electrodes 15, 16, between which a layer of piezoelectric material 9, for example PZT (Pb, Zr, $TiO_3$), extends.

A nozzle plate 17 is disposed on top of the third region 5, bonded to the latter by means of a layer of adhesive 18. The nozzle plate 17 has a hole 19, aligned and fluidically connected with the channel 13 through an opening 20 in the layer of adhesive 18. The hole 19 forms a nozzle of a jet emission channel, indicated overall with 21 and also comprising the through-channel 13 and the openings 14, 20.

In use, a fluid or liquid to be ejected is supplied to the fluid containment chamber 12 through the inlet channel 10 and an external control device (not shown) generates actuation control signals, applying suitable voltages between the pair of electrodes 15, 16. In particular, in a first step, the pair of electrodes 15, 16 is biased in such a manner as to cause a deflection of the membrane 7 towards the outside of the fluid containment chamber 12. The fluid containment chamber 12 increases in volume and is thus filled with liquid. In a second step, the piezoelectric actuator 8 is controlled in the opposite direction, in such a manner as to deflect the membrane 7 towards the inside of the fluid containment chamber 12, causing a movement of the fluid present in the fluid containment chamber 12 towards the jet emission channel 21. The controlled expulsion of a jet is thus generated, as shown by the arrow 23. Subsequently, the first step is carried out in such a manner as to once again increase the volume of the fluid containment chamber 12, demanding more fluid through the inlet channel 10.

Microfluidic devices with piezoelectric actuation of the type described are particularly advantageous as regards the print quality, the low costs and the minimal dimensions of the jet, which enables printing with great detail and/or high definition, as well as a high atomization density, to be obtained.

In general, each microfluidic device comprises a high number of ejector elements, disposed side by side, in such a manner as to supply the desired printing characteristics. For example, the individual ejector elements may be disposed side by side over various rows.

In some applications, it is desired for all the ejector elements to generate jets having the same volume and the same velocity of ejection. This may be obtained when all the ejector elements of the microfluidic device, inside of the same substrate, have equal dimensions, in particular, they have membranes with the same width and the same thickness.

One parameter that allows the performance characteristics of an ejector element to be quantified, and thus to evaluate whether the ejector elements of the microfluidic device are sufficiently equal, is the "compliance" of the membrane. In particular, the compliance C, in the case of membranes made of oxide/silicon/oxide, depends on the geometrical characteristics of the membrane according to the Roark formula ("Roark's Formulas for Stress and Strain", W. C. Young, R. G. Budynas, page 504, Table 11.4, McGraw-Hill, seventh edition), expressed in the following equation (1):

$$C = 0.142 \cdot \frac{L \cdot W^5}{E \cdot T^3} \tag{1}$$

wherein L is the length of the membrane (in a direction parallel to the axis X of a Cartesian coordinate system XYZ, FIG. 1), W is the width of the membrane (in a direction parallel to the axis Y), E is the Young's modulus of the membrane and T is the thickness of the membrane (in a direction parallel to the axis Z).

From studies by the applicant, it has been determined that, in order to provide that 95% of the ejector elements eject jets with a variability in volume of, at most, 10% and a variability in velocity of ejection of, at most, 10%, it is desirable for the thickness T of the membrane (in a direction parallel to the axis Z) to have a variation in thickness, compared with the design value, of no greater than 5% and for the width W of the membrane (in a direction parallel to the axis Y) to have a variation in width, compared with the design value, for example 100 μm, of no greater than 1%.

Whereas the control of the thickness of the membrane may be obtained with the usual techniques, it is difficult to obtain the control of the width W of the membrane with such a level of precision by means of the use of the usual fabrication techniques which comprise, for example, deep silicon etch steps. Indeed, for example in the case of a nominal width W of 80 μm, it is difficult to obtain a variability of less than 0.8 μm, in particular, considering that the etching of the fluid containment chamber (which determines the width of the membrane) is a deep etch, also of 100 μm or more. Furthermore, potential errors in alignment during the photolithography processes also have an influence on the width W of the membrane and also have an influence on the variability.

The result of this is that, with the current fabrication processes, the ejector elements exhibit a non-negligible dimensional variability, both as regards the variation in dimensions compared with the desired design values (variability of all the microfluidic devices within the same wafer), and as regards the variations existing between the various devices on the same wafer, and also as regards the variations existing between the various ejector elements within a device.

BRIEF SUMMARY

Provided is a microfluidic MEMS ("Micro Electro-Mechanical System") device, such as for inkjet printing and with piezoelectric actuation, and to a related manufacturing process for forming same.

BRIEF DESCRIPTION OF THE SEVERAL VIEWS OF THE DRAWINGS

For the understanding of the present disclosure, an embodiment thereof is now described purely by way of non-limiting example, with reference to the appended drawings, wherein:

FIGS. 5A-13A show cross-sections taken along the direction II-II of the ejector element in FIG. 2 in successive fabrication steps; and FIGS. 5B-13B show longitudinal sections taken along the direction V-V and with parts of the ejector element in FIG. 2 in transparency, in successive fabrication steps, corresponding to those in FIGS. 5A-13A.

DETAILED DESCRIPTION

Figure 1:
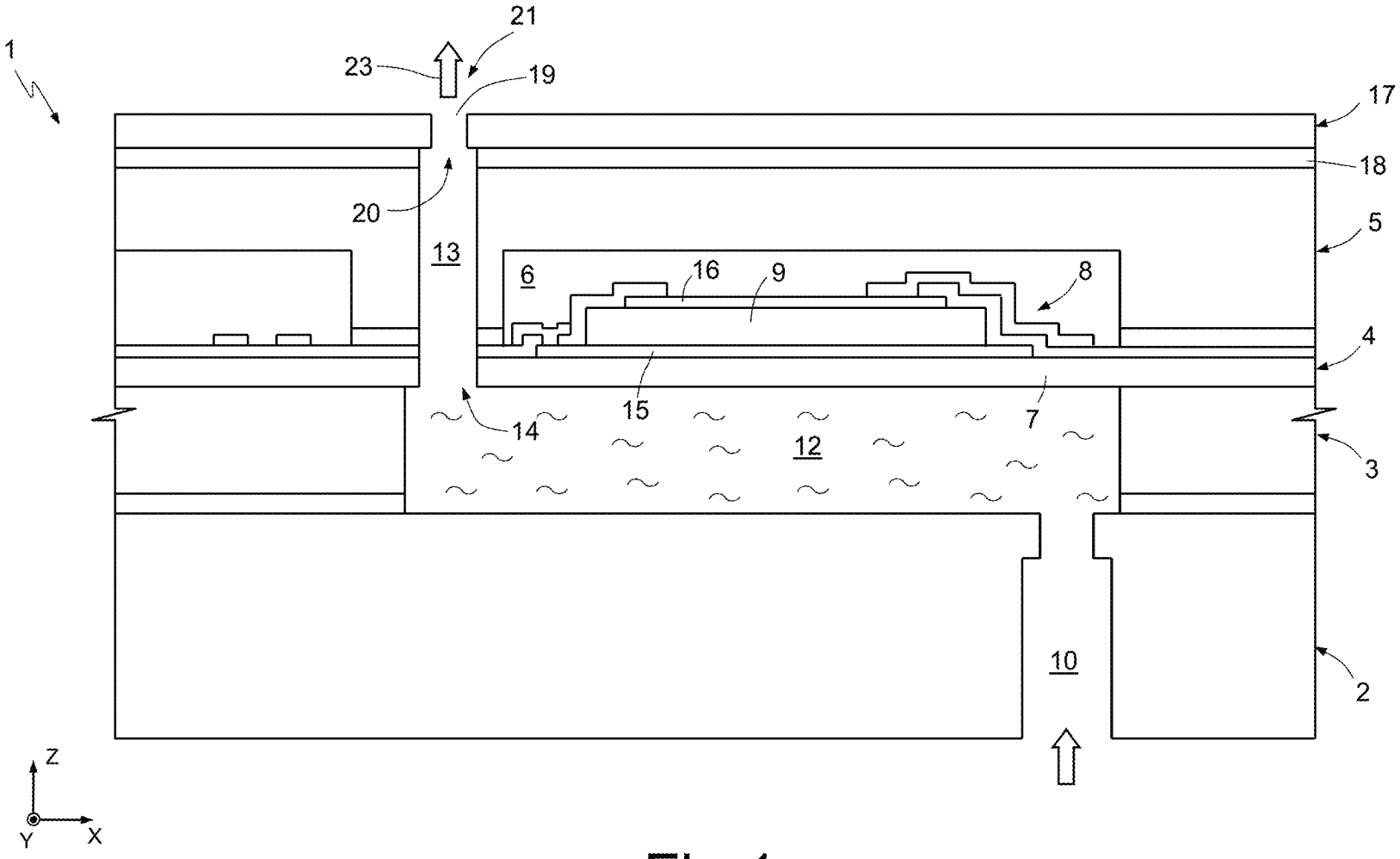
FIG. 1 shows a cross-section of an ejector element of a known microfluidic MEMS device for inkjet printing with piezoelectric actuation.
Figure 2:
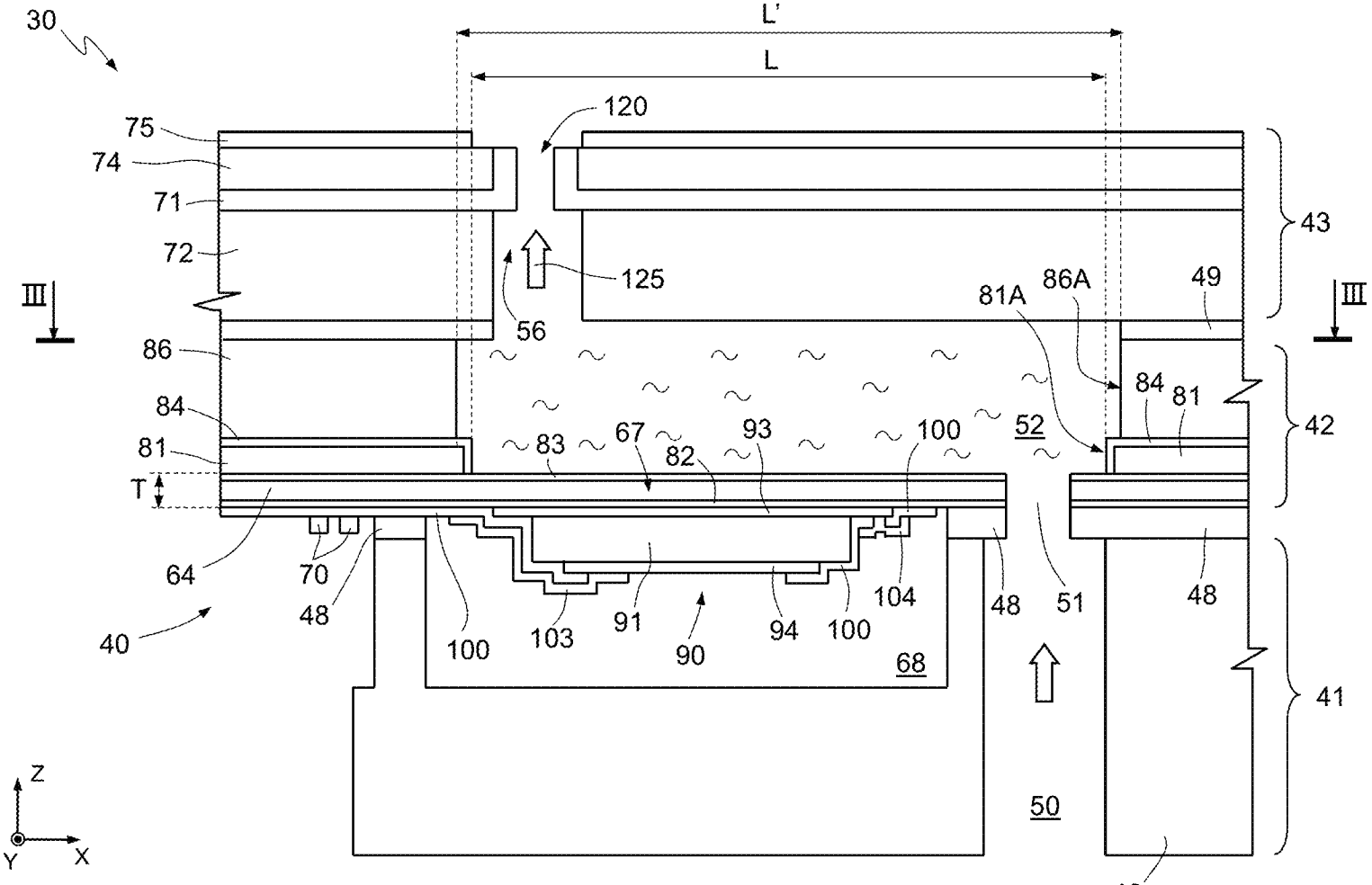
FIG. 2 shows a cross-section taken along the direction II-II in FIG. 3 of an ejector element of the present microfluidic MEMS device for inkjet printing with piezoelectric actuation.

FIG. 2 shows a single ejector element 40, integrated into a microfluidic device 30.

The ejector element 40 in FIG. 2 comprises a first, a second and a third region 41, 42, 43, mutually superposed and bonded.

The first region 41 is formed by a main body 46, made of semiconductor material, for example single-crystal silicon, vertically passing through which, in a direction parallel to the axis Z of a reference coordinate system XYZ, is an inlet channel 50 communicating with an external reservoir (not shown). The main body 46 furthermore forms an actuator chamber 68, disposed laterally to the inlet channel 50 and isolated with respect to the latter.

The second region 42 is superposed and bonded onto the first region 41 by means of a first layer of adhesive 48. The second region 42 comprises a membrane layer 64, a membrane definition element 81 and a chamber body 86, mutually superposed; for example, the membrane layer 64 and the membrane definition element 81 are made of polysilicon and the chamber body 86 is, for example, made of single-crystal silicon.

In detail, the membrane layer 64 is bonded to the first region 41 and encloses the actuator chamber 68 at the top.

Figure 3:
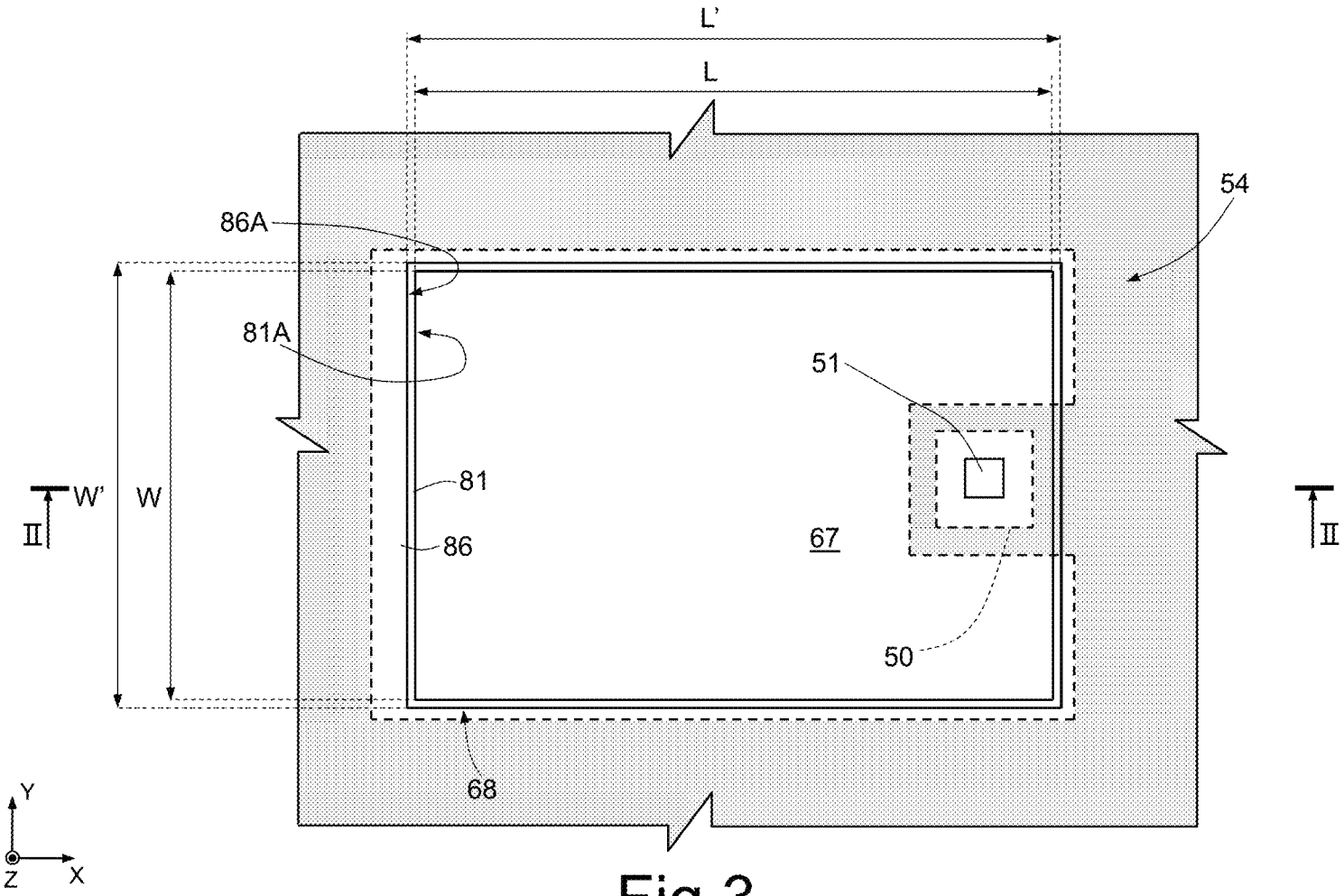
FIG. 3 shows a planar section taken along the plane III-III in FIG. 2, with parts of the ejector element in transparency.

The chamber body 86 and the membrane definition element 81 have respective openings (membrane definition opening 81A, and chamber opening 86A, see also FIG. 3) which laterally bound a fluid containment chamber 52. In the present microfluidic device 30, the chamber body 86 has a much greater thickness than the membrane definition layer 81, in particular at least twice as thick, for the reasons explained hereinbelow; for example, the chamber body 86 has a thickness equal to 50 μm, whereas the membrane definition layer 81 has a thickness equal to 10 μm.

The region of the membrane layer 64 disposed vertically below the opening 81A of the membrane definition element 81 forms a membrane 67.

The membrane layer 64 and the membrane definition element 81 are covered by insulating layers 82-84, of insulating material such as TEOS (Tetra-Ortho Silicate).

The fluid containment chamber 52 is in fluidic connection with the inlet channel 50 through an inlet hole 51 passing through the membrane layer 64 and the first layer of adhesive 48.

The membrane 67 carries, on its side facing the first region 41, a piezoelectric actuator 90 disposed inside of the actuator chamber 68. In a manner known per se, the piezoelectric actuator 90 is composed of a cell, composed of a first electrode 93, made of electrically-conductive material, for example of titanium (Ti) or platinum (Pt); a layer of piezoelectric material 91, for example PZT (Pb, Zr, $TiO_3$); a second electrode 94, for example of TiW (alloy of titanium and tungsten); and a layer of dielectric 100, for example of silicon oxide and silicon nitride deposited by CVD (Chemical Vapor Deposition). In particular, the layer of dielectric 100 extends on the sides of the piezoelectric material layer 91 and electrically isolates it from a first and a second contact track 103, 104, in electrical contact respectively with the second electrode 94 and the first electrode 93.

The membrane layer 64 furthermore carries, on its side facing the first region 41, a pair of contacts 70, made of conductive material, disposed laterally to the actuator chamber 68 and exposed to the outside of the microfluidic device 30.

The third region 43, made of semiconductor material, bounds the fluid containment chamber 52 at the top, and is superposed and bonded onto the second region 42 by means of a second layer of adhesive 49.

In detail, the third region 43 comprises an exit channel layer 72, made of semiconductor material, bounding the fluid containment chamber 52 at the top; a nozzle plate 74, positioned on top of the exit layer 48 and coupled to it by means of a layer of thermal oxide 71; and an anti-wettability layer 75, extending on top of the nozzle plate 74. The third region 43 furthermore has an exit through-channel 56 in communication with the fluid containment chamber 52.

In particular, the portion of the exit channel 56 formed in the nozzle plate 74 constitutes a nozzle, indicated with 120, for the emission towards the outside of jets of the liquid contained in the fluid containment chamber 52.

As shown in particular in FIG. 3, the membrane definition opening 81A and the chamber opening 86A have a rectangular shape, with a length in the direction parallel to the axis X and a width in the direction parallel to the axis Y. In particular, in the exemplary embodiment shown, the length of the membrane definition opening 81A and chamber definition opening 86A is measured in the direction of flow of the liquid originating from the inlet channel 50 along the fluid chamber 52 towards the exit channel 56.

In particular, in the ejector element 40, the effective dimensions of the membrane 67, in particular its width W along the second axis Y of the coordinate reference system XYZ, are determined by the dimensions of the membrane definition opening 81A.

In detail, FIG. 3 shows a portion of the ejector element 40 and, more precisely, the chamber body 86 and the related chamber opening 86A; the portion of the membrane definition element 81 projecting inside of the chamber opening 86A; the membrane definition opening 81A; the portion of the membrane layer 64, disposed inside of the area defined by the membrane definition opening 81A; the actuator chamber 68 (in transparency, with a dashed line); the inlet channel 50 (in transparency); and the inlet hole 51. The portion of the membrane layer 64 bonded to the first region 41 (FIG. 2) is represented in grey in FIG. 3.

As already indicated hereinabove, the portion of the membrane layer 64 shown in FIG. 3 and bounded by the membrane definition opening 81A forms the membrane 67 and has a length L in a direction parallel to the axis X of the coordinate reference system XYZ, a width W in a direction parallel to the axis Y and a thickness T in a direction parallel to the axis Z (FIG. 2).

As subsequently explained with reference to the fabrication process, the width dimension W and the length dimension L may be controlled in a precise manner by means of a photolithographic process on a thin layer and thus in a more accurate way with respect to the dimensions of the chamber opening 86A (width dimension W and length dimension L'), which on the other hand depend on a deep etch process (for example, "Deep Silicon Etch").

In particular, it is possible to control the width W of the membrane 67 with an error of less than 1%. Given that, as indicated by the equation (1), the compliance C depends on the fifth power of the width W of the membrane 67 and directly on the length L, in this way it is possible to considerably reduce the variability of the operating characteristics of the ejector element 40.

Figure 4:
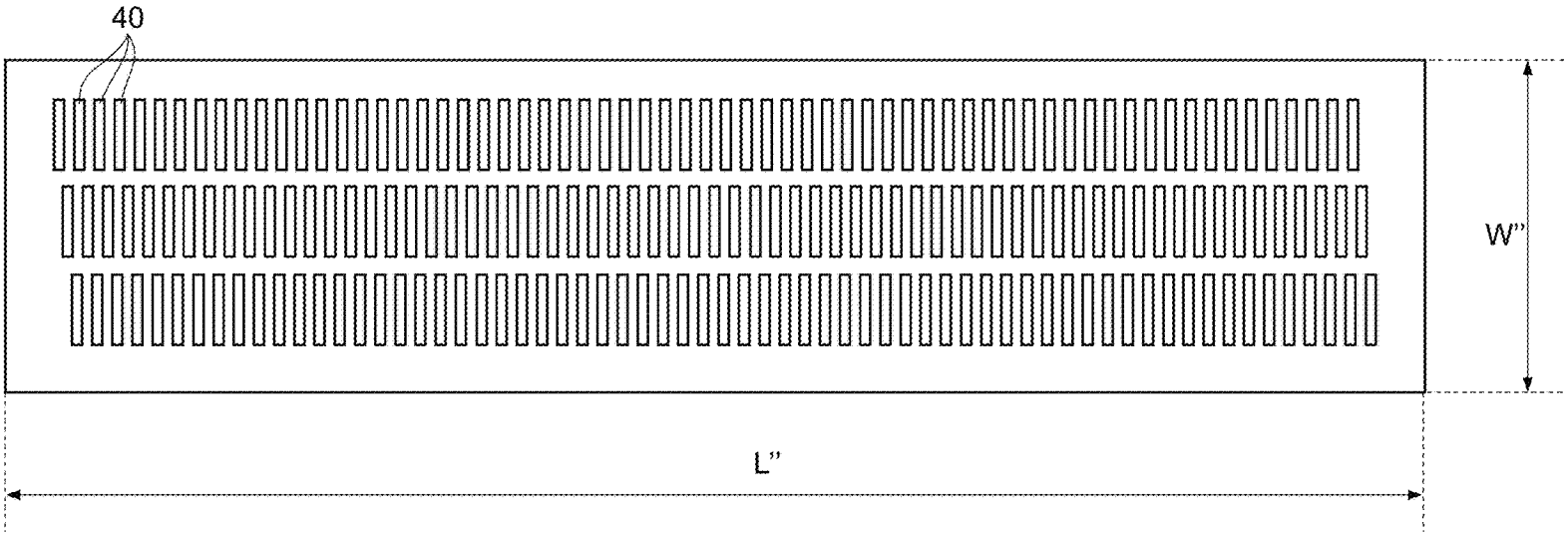
FIG. 4 shows a simplified view from above showing the arrangement of a plurality of ejector elements in the present microfluidic MEMS device for inkjet printing with piezoelectric actuation.

This is particularly important, taking into account that each device 30 comprises a plurality of ejector elements 40 and these may exhibit a dimensional variability between them. For example, the ejector elements 40 may be disposed in the manner shown in FIG. 4, side by side, in different rows, in the microfluidic device 30. A microfluidic device 30 of the type being considered with, for example, a length (indicated in FIG. 4 with L") of around 23 mm and a width (indicated in FIG. 4 with W') of around 6 mm, may contain for example up to 1200 ejector elements 40.

With the structure in FIGS. 2 and 3, it is thus possible to obtain that 95% of the ejector elements 40 exhibit a variability in the weight of the ejected jets of less than 10%. A similar improvement in precision is obtained with regard to the velocity of ejection of the jets.

The fabrication steps for the ejector element 40 are illustrated in FIGS. 5A to 13A and 5B to 13B.

Figure 5B:
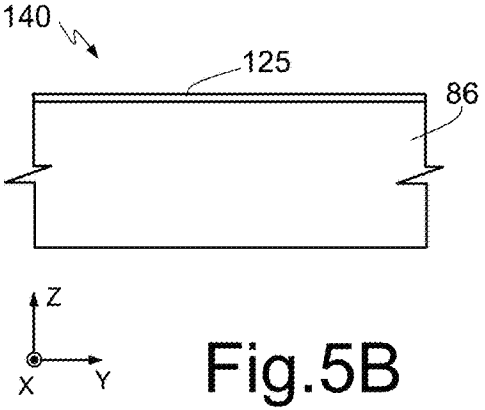
Figure 5A:
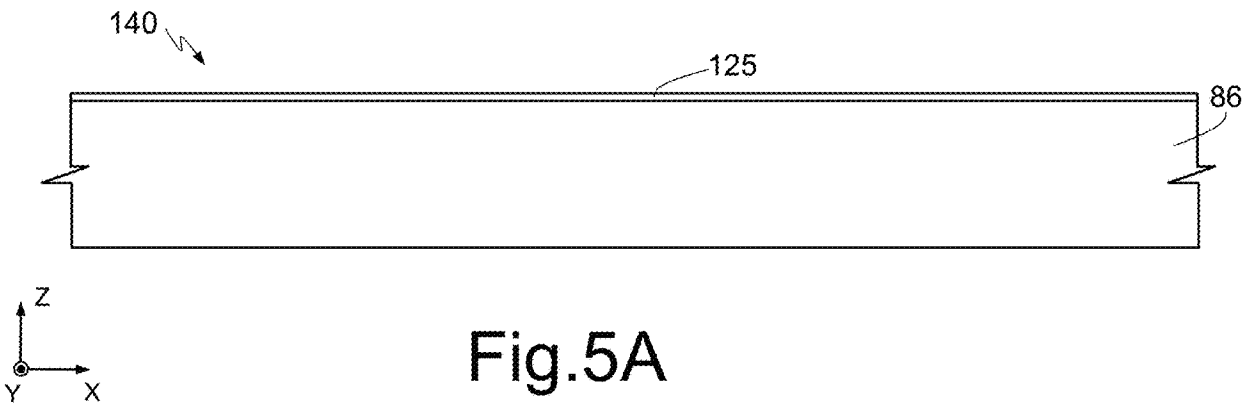

As shown in FIGS. 5A and 5B, a protective layer 125 of silicon oxide is thermally grown, by means of known growth techniques, on a wafer of semiconductor material designed to form the chamber body 86 in FIG. 2, and thus indicated with the same reference number. The wafer thus formed is indicated overall with the reference number 140.

Figure 6B:
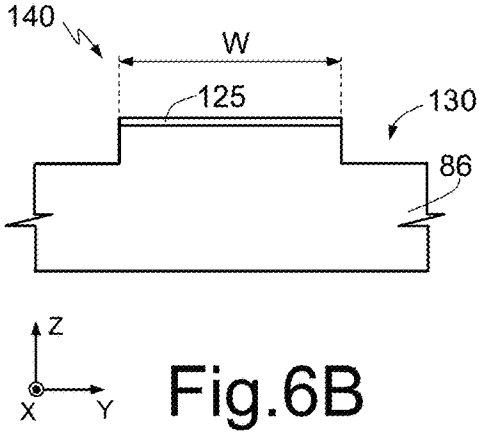
Figure 6A:
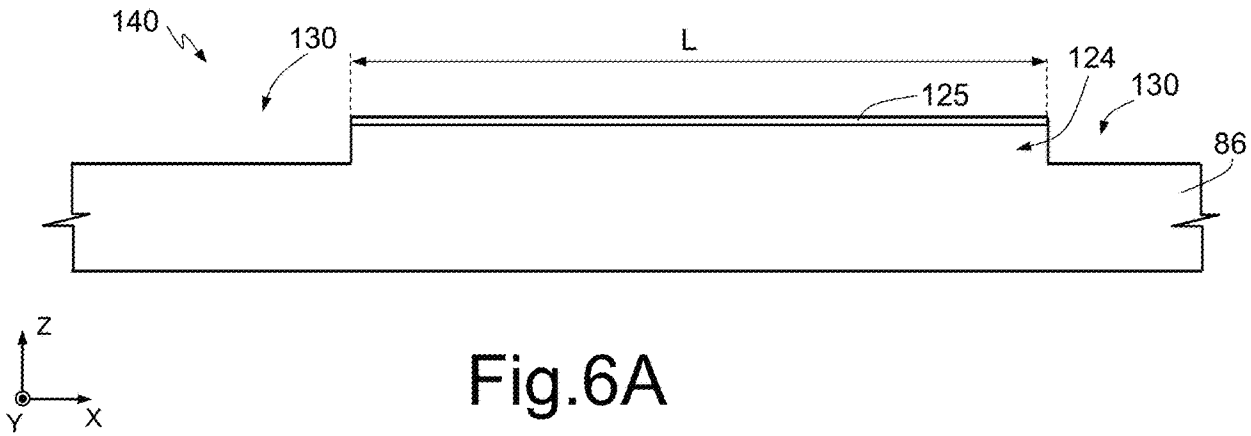
Figure 7B:
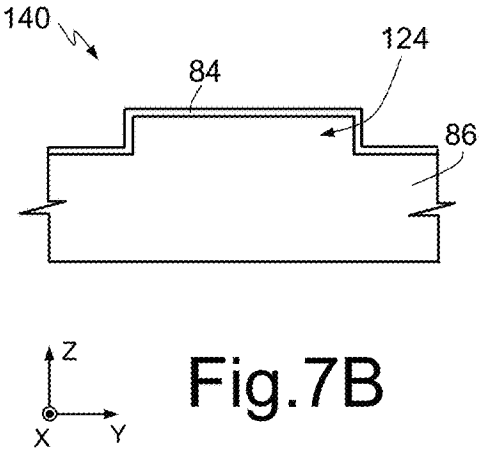
Figure 7A:
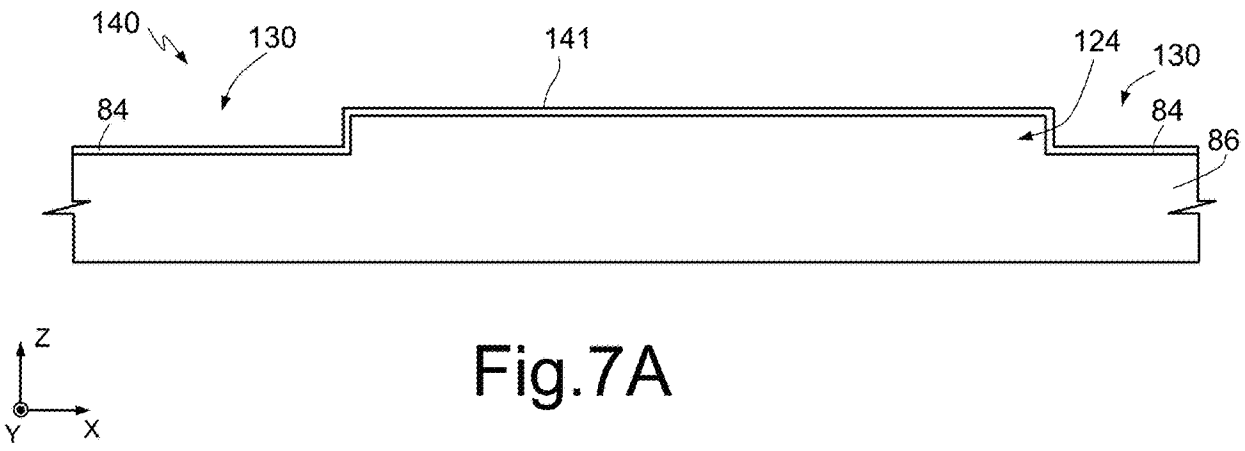

With reference to FIGS. 6A and 6B, selective portions of the first wafer 140 are removed using known etch techniques (for example, "Deep Silicon Etch"), thus forming a lateral recess 130 surrounding a protruding portion 124 having, in a view from above, a rectangular shape with a length L and width W, or with dimensions equal to those of the membrane 67 to be formed (FIGS. 2, 3). The recess 130 in the first wafer 140 has a depth, in a direction parallel to the axis Z, for example of around 10 μm.

A first etch stop layer 141 is deposited on the surface of the first wafer 140 over a thickness, for example, equal to 0.6 μm; subsequently, the first etch stop layer 141 is thermally densified according to known techniques, thus forming (on the walls and on the bottom of the lateral recess 130) the third insulating layer 84. Furthermore, on top of the portion 124 protruding from the lateral recess 130, the first etch stop layer 141 incorporates the protective layer 125.

Figure 8B:
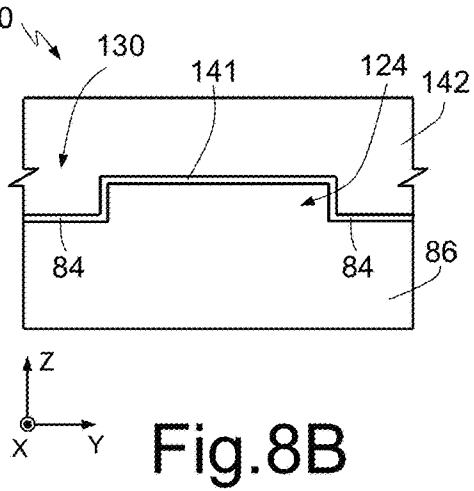
Figure 8A:
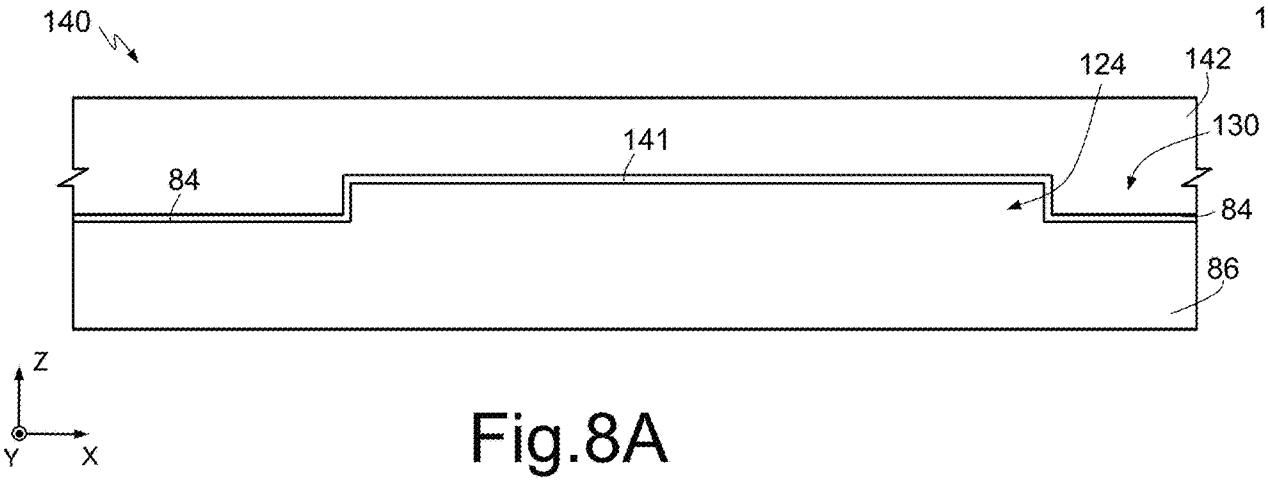

In the following, FIGS. 8A and 8B, using known techniques, a first epitaxial layer 142, which fills the lateral recess 130, is grown on the surface of the first wafer 140. The first epitaxial layer 142 is grown over a thickness, in a direction parallel to the axis Z, for example equal to around 30 μm.

Figure 9B:
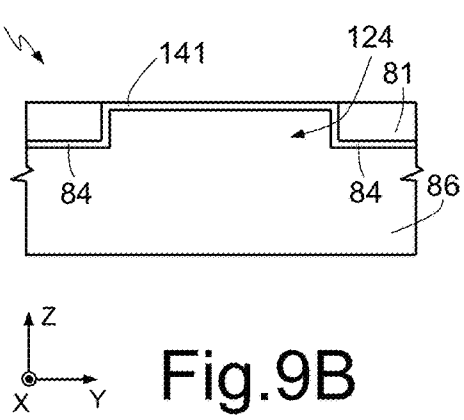
Figure 9A:
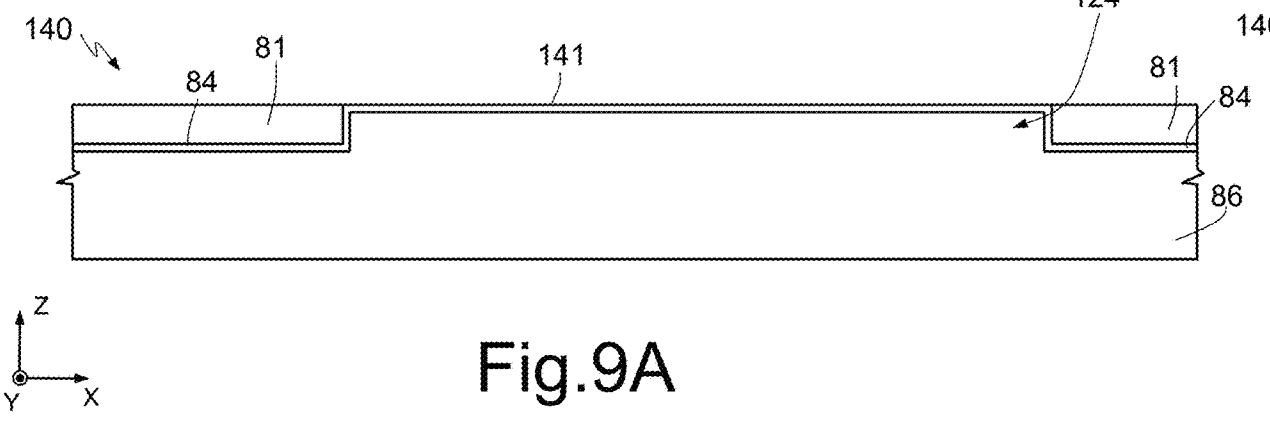

In FIGS. 9A, 9B, the epitaxial layer 142 is thinned and planarized according to known techniques; in particular, the first epitaxial layer 142 is reduced by around 15 μm in the direction of the depth (parallel to the axis Z) by means of a grinding step; subsequently, the surface of the first epitaxial layer 142 is polished by means of known techniques, such as CMP (Chemical Mechanical Polishing). In this way, the thickness of the first epitaxial layer 142 is further reduced by around 5 μm and planarized; furthermore, in the polishing step, the first etch stop layer 141 allows the polishing to be stopped, thus acting as a "hard stop". In this way, the remaining portions of the first epitaxial layer 142 form the membrane definition layer 81.

Figure 10B:
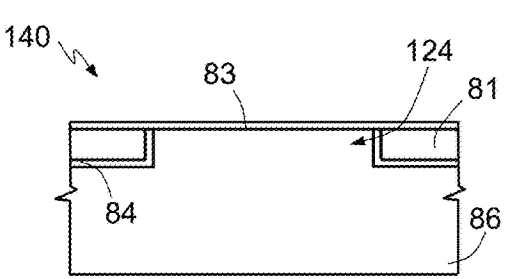
Figure 10A:
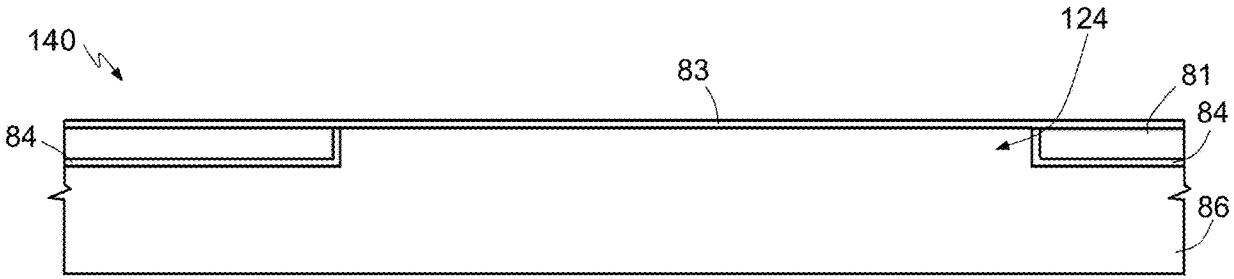

With reference to FIGS. 10A and 10B, a second stop layer (not shown) is deposited on the first epitaxial layer 142 thus thinned; in particular, the second insulating layer has a thickness (in a direction parallel to the axis Z) of around 0.6 μm. The second insulating layer is densified, thus forming the second insulating layer 83 which, on top of the protruding portion 124, incorporates the first etch stop layer 141 and the protective layer 125.

Figure 11B:
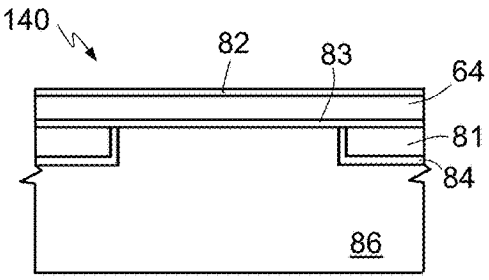
Figure 11A:
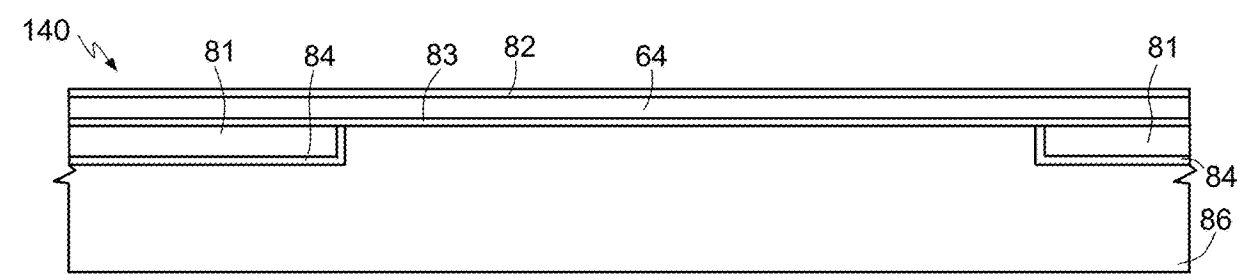
Figure 12B:
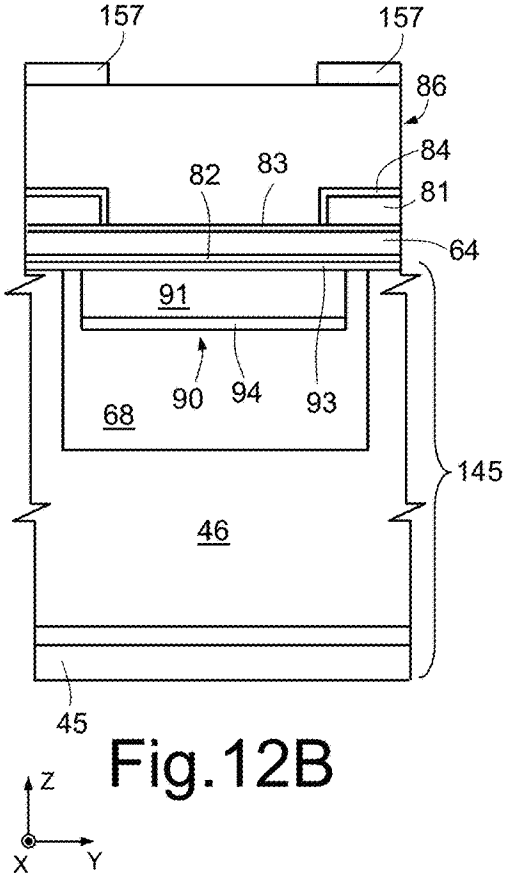
Figure 12A:
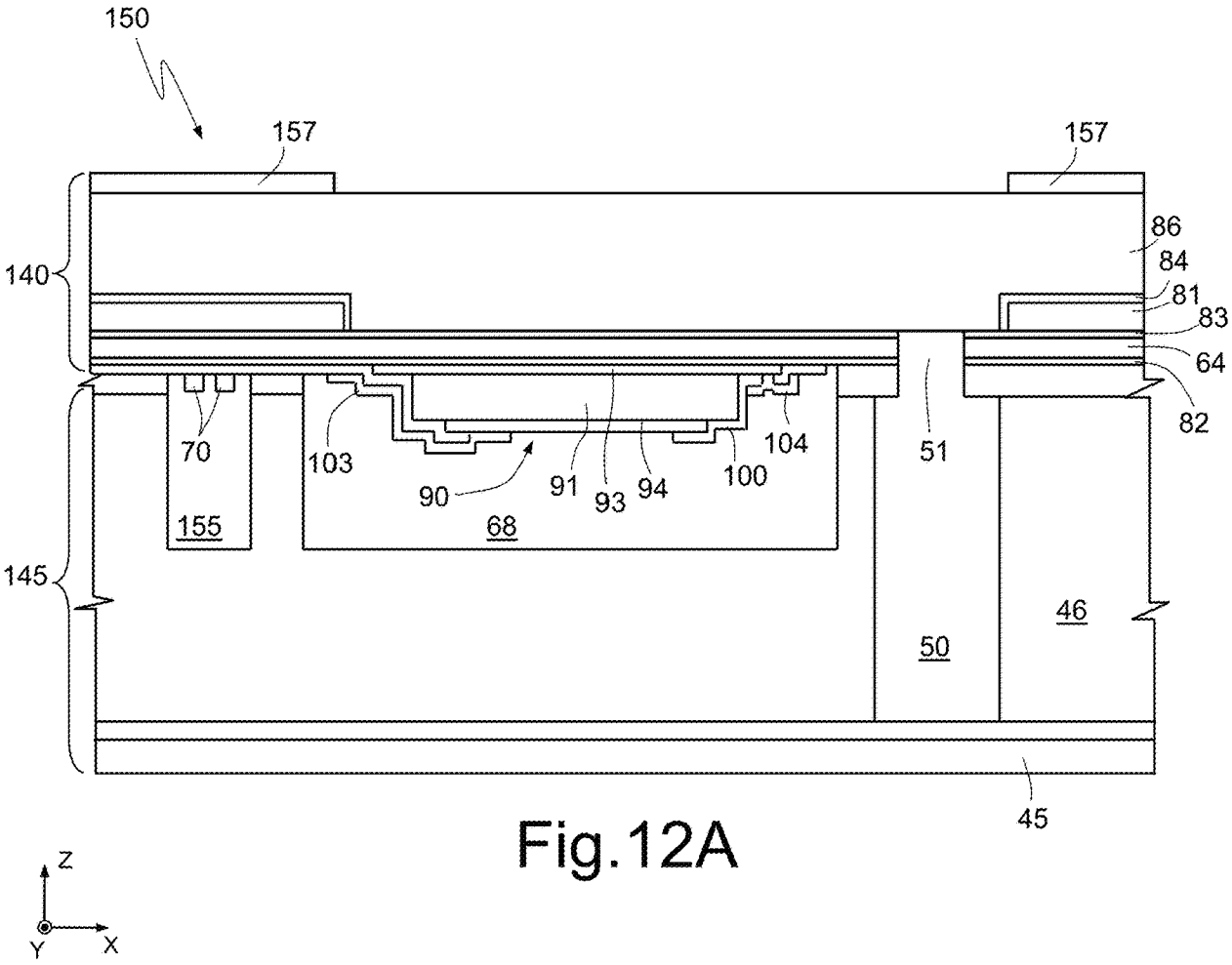

As shown in FIGS. 11A and 11B, a second epitaxial layer is grown in a controlled manner on the surface of the second insulating layer 83, over a thickness, for example in the range between 2 μm and 10 μm, forming the membrane layer 64. Thus, a layer of dielectric material (not shown) is deposited and densified accordingly forming the first insulating layer 82.

Steps similar to those described in the U.S. Pat. No. 2014/0313264, which is incorporated herein by reference, are carried out, in such a manner as to obtain a composite wafer 150, shown in FIGS. 12A and 12B. In particular, the first wafer 140 is etched, according to known techniques, in order to form the inlet hole 51; subsequently, the first electrode 93, the layer of piezoelectric material 91, the second electrode 94, the layer of dielectric 100 and the contact tracks 103, 104, together with the contacts 70, are formed.

Furthermore, a second wafer 145 is bonded to a carrier plate 45 and is processed in such a manner as to form the actuator chamber 68, the inlet channel 50 and a contact chamber 155, disposed laterally to the actuator chamber 68. The second wafer 145 is thus bonded to the first wafer 140 by means of the first layer of adhesive 48, in a similar manner to what has been described in the U.S. Pat. No. 2014/0313264, thus obtaining the composite wafer 150.

Figures 13A, 13B:
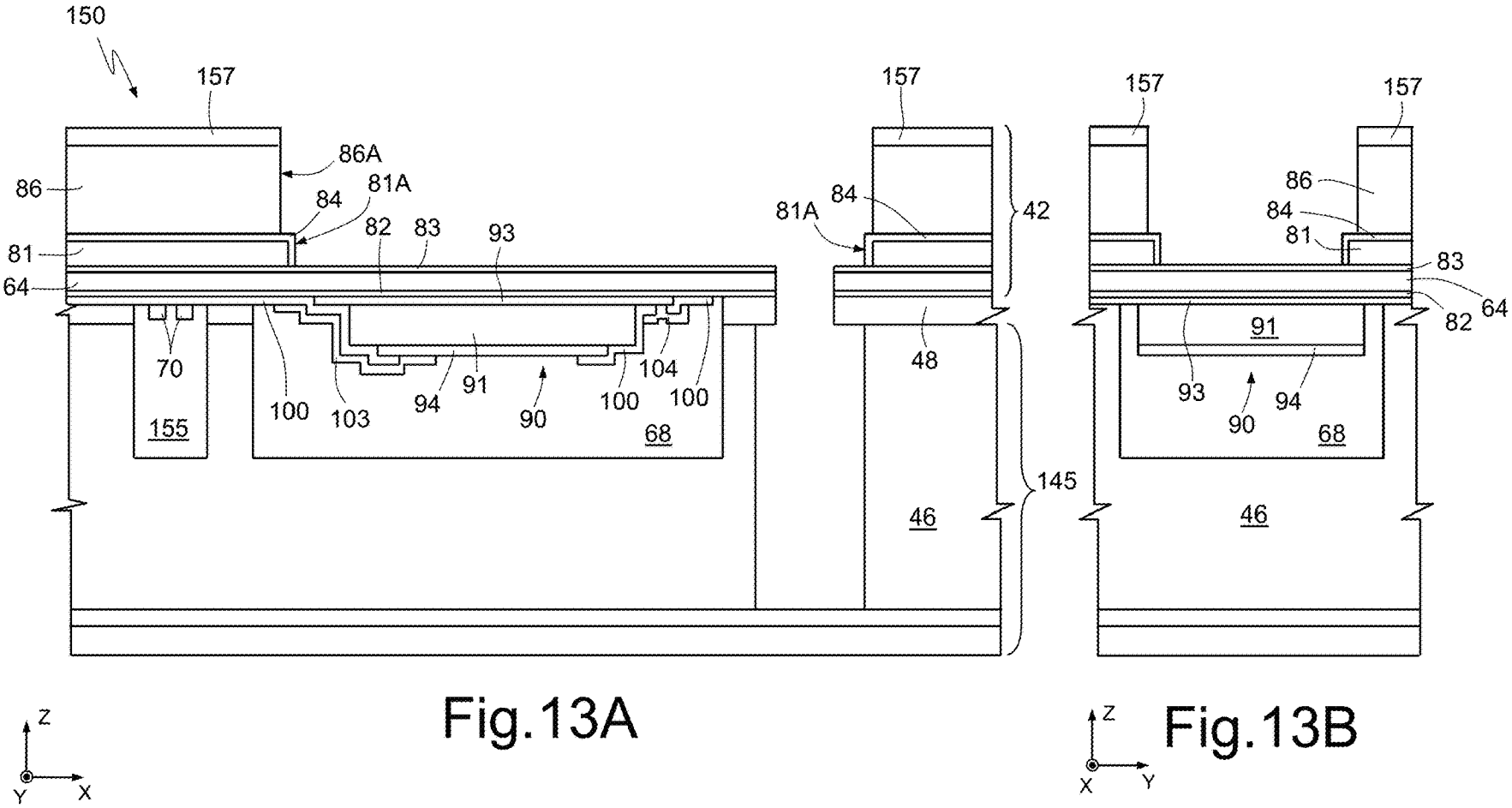

Thus, as shown in FIGS. 13A and 13B, the first wafer 140 is etched by means of a deep etch process, using a mask 157, according to known masking and etching techniques, in such a manner as to form the second region 42. In particular, the deep etch step allows a part of the material of the first wafer 140 to be removed, forming the chamber opening 86A (whose dimensions are determined by the mask 157), and the membrane definition opening 81A (whose dimensions are determined by the protruding portion 124, by virtue of the presence of the third insulating layer 84 which covers the portions of the second epitaxial layer 142 forming the membrane definition layer 81). In this way, the chamber body 86 is defined.

The dimensioning of the mask 157 is designed taking into account potential errors in alignment in such a manner as to ensure that this defines an etching window that is larger and outside (as seen from above) of the chamber definition opening 81A, in such a manner that the chamber layer 86 does not influence the dimensions of the membrane 67.

In a manner not shown, the third region 43, processed in a similar manner to that described by the U.S. Pat. No. 2014/0313264, is bonded to the second region 42 by means of the second layer of adhesive 49. Furthermore, the inlet channel 50 is formed, the carrier plate 45 and a portion of the first region 41 disposed on top of the contact chamber 155 are removed, rendering the contacts 70 accessible from the outside for subsequent wire bonding steps.

In this way, the ejection element 40 in FIG. 2 is obtained.

The advantages of the present ejector element and of the present device are the following.

The fabrication process for the second region 42 allows the effective dimensions of the membrane 67 to be determined by means of the dimensioning of the membrane definition opening 81A, which may be achieved in a particularly precise manner by virtue of the use of photolithographic definition techniques on a relatively thin layer (membrane definition layer 81). In particular, as indicated, this dimensioning allows a limited variability of the dimensions of the length L and, above all, of the width W of the membrane 67 to be obtained.

Furthermore, the definition of the dimensions of the membrane 67 through the membrane definition layer 81 means that potential errors in alignment of the mask 157 do not have an impact on the compliance of the membrane 67.

In this way, the variability in dimensions, both between the individual ejection elements 40 in each microfluidic device 30, and between the various microfluidic devices 30 formed within the same wafer, is reduced.

Finally, it will be clear that modifications and variants may be applied to the device and method described and illustrated here without however straying from the scope of protection of the present disclosure.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A microfluidic device, comprising:

a plurality of ejector elements, each ejector element including:

a first region having a first fluid flow channel and an actuator chamber;

an actuator in the actuator chamber;

a second region having a fluid containment chamber fluidically coupled to the first fluid flow channel, the second region comprising:

a membrane layer coupled to the first region, the membrane layer having a first surface closing the fluid containment chamber and supporting the actuator;

a membrane definition layer coupled to the membrane layer and having a membrane definition opening, the membrane definition opening having a width in a plane of the membrane definition layer, wherein the plane of the membrane definition layer is parallel to a surface of the membrane layer that is exposed by the membrane definition opening; and a chamber defining body coupled to the membrane definition layer and having a chamber defining opening; and a third region coupled to the second region and having a second fluid flow channel fluidically coupled to the fluid containment chamber;

wherein the fluid containment chamber is delimited by the membrane layer, the membrane definition layer, the chamber defining body and the third region, wherein the chamber defining opening has, in a direction parallel to the plane, a width greater than the width of the membrane definition opening, and wherein the membrane definition opening defines a flexible membrane in the membrane layer.

2. The device according to claim 1, wherein the fluid containment chamber, in the length direction, has a first end and a second end, the first fluid flow channel comes out at the first end and the second fluid flow channel comes out at the second end of the fluid containment chamber.

3. The device according to claim 1, wherein the membrane definition opening and the chamber defining opening have rectangular shapes, and wherein the chamber defining opening has a larger area and surrounds the membrane definition opening.

4. The device according to claim 1, wherein the membrane definition layer is made of a first material, wherein the membrane layer is made of a second material, wherein the membrane definition layer is surrounded by a first protective layer of a third material, and wherein the membrane layer is covered, on a second surface opposite to the first surface, by a second protective layer of a fourth material.

5. The device according to claim 4, wherein the first and the second materials are semiconductor materials, and wherein the first and the second protective layers are made of dielectric materials.

6. The device according to claim 1, wherein the membrane definition layer has a first thickness and the fluid chamber defining body has a second thickness, and wherein the second thickness is greater than the first thickness.

7. The device according to claim 1, wherein the actuator is a piezoelectric actuator that comprises:

a first electrode on the first surface of the membrane layer;

a piezoelectric layer extending over the first electrode;

a second electrode extending over the piezoelectric layer;

a layer of dielectric extending, at least in part, over the membrane layer and over the first and over the second electrode; and a first contact track and a second contact track extending, at least in part, over the layer of dielectric.

8. The device according to claim 1, wherein the first fluid flow channel is an inlet channel and the second fluid flow channel is an exit channel.

9. A microfluidic device, comprising:

a plurality of ejector elements, each ejector element including:

a first portion having a first fluid flow channel and an opening;

a second portion including:

a membrane layer coupled to the first portion, the membrane layer covering the opening of the first portion and forming an actuator chamber;

a membrane definition layer coupled to the membrane layer and having a membrane definition opening, the membrane definition opening defines a flexible membrane in the membrane layer, the membrane definition opening having a width in a plane of the membrane definition layer, wherein the plane of the membrane definition layer is parallel to a surface of the membrane layer that is exposed by the membrane definition opening; and a chamber defining body coupled to the membrane definition layer and having a chamber opening, wherein the chamber opening has, in a direction parallel to the plane, a width greater than the width of the membrane definition opening;

a third portion coupled to the second portion, wherein the third portion, the membrane layer, and the chamber opening in the chamber defining body forms a fluid containment chamber, wherein the third portion includes a second fluid flow channel fluidically coupled to the fluid containment chamber; and an actuator located on the flexible membrane and in the actuator chamber.

10. The microfluidic device according to claim 9, wherein the first fluid flow channel is an inlet channel and the second fluid flow channel is an exit channel.

11. The microfluidic device according to claim 9, wherein the actuator is of a piezoelectric actuator.

12. The microfluidic device according to claim 9, wherein the membrane definition layer is made of a semiconductor material, and wherein the membrane layer is made of a semiconductor material.

13. A microfluidic device comprising:

a plurality of ejector elements, each ejector element including:

a first semiconductor body having a first fluid flow channel and an opening;

a second semiconductor body coupled to the first semiconductor body, the second semiconductor body including a membrane layer, a membrane definition layer, and a main body having an opening, the membrane layer covering the opening of the first semiconductor body and forming an actuator chamber, the membrane layer including a flexible membrane at the actuator chamber, the membrane layer including a chamber opening in fluid communication with the first fluid flow channel and the opening, the chamber opening having a width that is less than a width of the first fluid flow channel, the membrane definition opening having a width in a plane of the membrane definition layer, wherein the plane of the membrane definition layer is parallel to a surface of the membrane layer that is exposed by the membrane definition opening;

a third semiconductor body coupled to the second semiconductor body, wherein the third semiconductor body, the membrane layer, and the opening of the second semiconductor body form a fluid containment chamber, wherein the third semiconductor body includes a second fluid flow channel fluidically coupled to the fluid containment chamber; and an actuator located on the flexible membrane and in the actuator chamber.

14. The microfluidic device according to claim 13, wherein the first, second, and third semiconductor bodies are made of silicon.

15. The microfluidic device according to claim 13, wherein the main body of the second semiconductor body is single-crystal silicon.

16. The microfluidic device according to claim 15, wherein the membrane layer is polysilicon.

17. The microfluidic device according to claim 13, wherein the membrane layer has a first thickness and the main body has a second thickness, the second thickness being greater than the first thickness.

18. The microfluidic device according to claim 13, wherein the fluid containment chamber, in the length direction, has a first and a second end, the first fluid flow channel opens out at the first end and the second fluid flow channel opens out at the second end of the fluid containment chamber.

19. The microfluidic device according to claim 13, wherein the actuator is a piezoelectric actuator that comprises:

a first electrode on the first surface of the membrane layer;

a piezoelectric layer extending over the first electrode;

a second electrode extending over the piezoelectric layer;

a layer of dielectric extending, at least in part, over the membrane layer and over the first and over the second electrode; and a first contact track and a second contact track extending, at least in part, over the layer of dielectric.

* * * * *